US006698844B2

(12) United States Patent
Itou et al.

(10) Patent No.: US 6,698,844 B2
(45) Date of Patent: Mar. 2, 2004

(54) EARTH DISCHARGING DEVICE FOR UPWARD-FACING SHIELD MACHINE

(75) Inventors: Hiroyuki Itou, Kuwana (JP); Yuuichi Asai, Aichi (JP); Osamu Takagi, Musashino (JP); Kazuo Takamizawa, Koshigaya (JP); Fumio Kondou, Yao (JP); Hidetoshi Sakamoto, Osaka (JP)

(73) Assignees: Taisei Corporation, Tokyo (JP); Ishikawajima-Harima Heavy Industries Co., Ltd., Tokyo (JP)

( * ) Notice: Subject to any disclaimer, the term of this patent is extended or adjusted under 35 U.S.C. 154(b) by 0 days.

(21) Appl. No.: 10/245,993

(22) Filed: Sep. 17, 2002

(65) Prior Publication Data

US 2003/0118408 A1 Jun. 26, 2003

(30) Foreign Application Priority Data

Dec. 26, 2001 (JP) ..... 2001-394876

(51) Int. Cl.[7] ..... E21D 9/12
(52) U.S. Cl. ..... 299/56; 299/58; 405/141
(58) Field of Search ..... 299/56, 58; 405/133, 405/132, 138, 141, 142, 143, 145, 146

(56) References Cited

U.S. PATENT DOCUMENTS 4,167,289 A * 9/1979 Ono et al. ..... 405/141
4,171,848 A * 10/1979 Ono ..... 405/141
4,456,305 A * 6/1984 Yoshikawa ..... 299/33
4,482,045 A * 11/1984 Voss ..... 198/670
4,763,954 A * 8/1988 Soltau ..... 299/56
5,072,992 A * 12/1991 Gorbunov et al. ..... 299/33

FOREIGN PATENT DOCUMENTS

JP 09/41882 * 2/1997
JP 09-041881 2/1997
WO 91/021140 * 2/1991

* cited by examiner

*Primary Examiner*—Frederick L. Lagman
(74) *Attorney, Agent, or Firm*—McCormick, Paulding & Huber LLP

(57) ABSTRACT

An earth discharging device, for a shield machine for constructing a tunnel in the vertical direction, has a pipe for discharging downwardly earth and sand that have been excavated by the machine as it advances upwardly. An elastic film-type valve is provided in the earth discharging pipe, which valve expands and contracts diametrically by means of fluid pressure to open and close the interior of the earth discharging pipe. A gate mechanism follows the elastic valve and adjusts the sectional area of the space through which earth and sand pass inside of the earth discharging pipe. The gate mechanism narrows the sectional area of the earth discharging pipe at the outlet side of the elastic valve so as to create a substantially uniform earth pressure upon the entire elastic valve to inhibit blockages and eruptions that might otherwise occur.

20 Claims, 5 Drawing Sheets

Title: EARTH DISCHARGING DEVICE FOR UPWARD-FACING SHIELD MACHINE
First Named Inventor: Hiroyuki I
Serial Number: 10/245,993
Attorney Docket Number: 5525-23
Replacement Sheet

EARTH DISCHARGING DEVICE FOR UPWARD-FACING SHIELD MACHINE

CROSS REFERENCES TO RELATED APPLICATIONS

This application is entitled to the benefit of and incorporates by reference essential subject matter disclosed in Japanese Patent Application No. 2001-394876 filed Dec. 26, 2001.

BACKGROUND OF THE INVENTION

1. Field of the Invention

The present invention relates to an earth discharging device for an upward-facing shield machine, and more particularly to an upward-facing shield machine which can securely perform earth pressure control of a work face.

2. Description of the Related Art

FIG. 6 illustrates an earth discharging device for an upward-facing shield machine a previously disclosed by the present inventors. As is shown in the drawing, the upward-facing shield machine a comprises: a vertically-placed tubular shield frame b; a partition wall c which divides the interior of the shield frame b into a work face side and an interior side; and a cutter d which is rotatably mounted on the partition wall c. The shield machine a constructs a tunnel in the vertical direction by causing the cutter d to rotate using a motor e while a jack g is expanded under a reaction force to a pre-installed segment f to cause the shield frame b to rise, whereupon the jack g is caused to contract such that a segment can be provided in a tensioned state in the space between the pre-installed segment f and the jack g manually or using an erector (not shown in the drawing).

The earth and sand that are cut away by the cutter d are taken into a cutter chamber h and discharged by an earth discharging device i. The earth discharging device i comprises: an earth discharging pipe j which is connected to the cutter chamber h and extends downward; an elastic film-type valve k which is provided in the earth discharging pipe i and which opens and closes the interior of the earth discharging pipe i by expanding and contracting diametrically by means of fluid pressure; and an agitator 1 which kneads and fluidizes the excavated earth and sand so that this mixture can be excluded downward more easily by means of gravitational force. The agitator 1 comprises: a rotary shaft n which is disposed in the interior of the earth discharging pipe i and is rotated by a motor m; a collar o which is rotatably fitted over the part the rotary shaft n which faces the elastic film-type valve k; and a kneader blade p which is mounted on the part of the rotary shaft n inside the cutter chamber h.

Meanwhile, the elastic film-type valve k comprises: a tubular elastic film q (rubber film or the like) disposed at a point in the earth discharging pipe i; a tubular casing s which is disposed in a form which covers the outer side of the elastic film q and which forms a pressurizing chamber r with the peripheral surface of the elastic film q; and a supply and discharge port t which is opened in the casing s for supplying and discharging fluid (air, water, etc.) into and out of the pressurizing chamber r. The elastic film-type valve k manages adjustments to the earth pressure on the work face by supplying and discharging fluid into and out of the pressurizing chamber r through the supply and discharge port t such that the elastic film q is caused to expand and contract diametrically to adjust the amount of earth to be discharged.

However, in the aforementioned elastic film-type valve k, when fluid pressure acts equally on the elastic film q, the earth and sand that pass therethrough are at work face pressure (high pressure) at the inlet side and atmospheric pressure (low pressure) at the outlet side. As a result, the elastic film q does not expand equally, as is illustrated by the wavy line in FIG. 6, but is locally pressed inward, as is illustrated by the solid line in the figure, at the outlet side due to the pressure difference between the inlet side and outlet side, thereby becoming tightly pressed against the collar o.

As a result, when the earth and sand at work face pressure inside the cutter chamber h pass through the elastic film-type valve k to drop to the atmospheric pressure side, the earth and sand are locally pressed inward by the pressure difference at the outlet side, whereby the opening adjustment of the elastic film q by means of fluid pressure inside the pressurizing chamber r increases in sensitivity, and earth pressure control at the work face becomes unstable. More specifically, even if the sectional area of the space through which the earth and sand pass is altered in order to control earth pressure at the work face by varying the supply force of fluid to the pressurizing chamber r and varying the amount of expansion of the elastic film q, the elastic film q will be locally pressed inward at the outlet side due to the pressure difference between the upper and lower regions, thereby becoming tightly pressed against the collar o, and as a result, even small alterations in the fluid pressure of the fluid supplied to the pressurizing chamber r will invite repeated blockages and eruptions of the earth and sand, making earth pressure control at the work face unstable.

The pressure difference between the inlet side (work face pressure) and outlet side (atmospheric pressure) grows particularly large when advancing at great depth, and thus the elastic film q is locally pressed inward at the outlet side in accordance with this pressure difference, causing repeated earth and sand blockages and eruptions. Furthermore, in cases where the earth and sand are of a type, such as gravel with a large particle diameter or sandy soil with high frictional resistance, that is difficult to fluidize even using the agitator 1 or by injecting a mud-forming agent or the like, the earth and sand at the narrow opening of the elastic film q, which is locally pressed inward, have a tendency to become blocked such that the frequency of eruptions increases. Consequently, earth pressure control directly above the shield machine a becomes unstable, leading to the possibility of displacement at ground level.

SUMMARY OF THE INVENTION

An object of the present invention is to provide an earth discharging device for an upward-facing shield machine which can securely perform work face earth pressure control.

In order to achieve this object, the earth discharging device for an upward-facing shield machine according to the present invention is comprised of: an earth discharging pipe which is disposed in a longitudinal direction in order to discharge downward earth and sand excavated by an upward-advancing, upward-facing shield machine; an elastic film-type valve which is provided in this earth discharging pipe, and which expands and contracts diametrically by means of fluid pressure to open and close the interior of the earth discharging pipe; and a gate mechanism which is provided further toward the outlet side of the earth discharging pipe than the elastic film-type valve, and which adjusts the sectional area of the space inside the earth discharging pipe through which earth and sand pass.

According to the present invention, the earth pressure of the earth and sand can be raised by using the gate mechanism to narrow the sectional area of the space inside the earth discharging pipe at the outlet side of the elastic film-type valve through which earth and sand pass such that the earth and sand at the outlet side of the elastic film-type valve become slightly blocked. Thus, the earth pressure at the outlet side of the elastic film-type valve can be made substantially equal to the earth pressure at the inlet side, whereby a substantially uniform earth pressure can be caused to act upon the entire elastic film-type valve. As a result, the elastic film-type valve expands substantially uniformly, and the earth and sand are pressed inward by the entire elastic film-type valve. Thereby, blockages and eruptions of the earth and sand can be avoided, and earth pressure control can be performed securely regardless of depth or soil type.

DESCRIPTION OF THE PREFERRED EMBODIMENTS

An embodiment of the present invention will now be explained based on the attached drawings.

Figure 1:
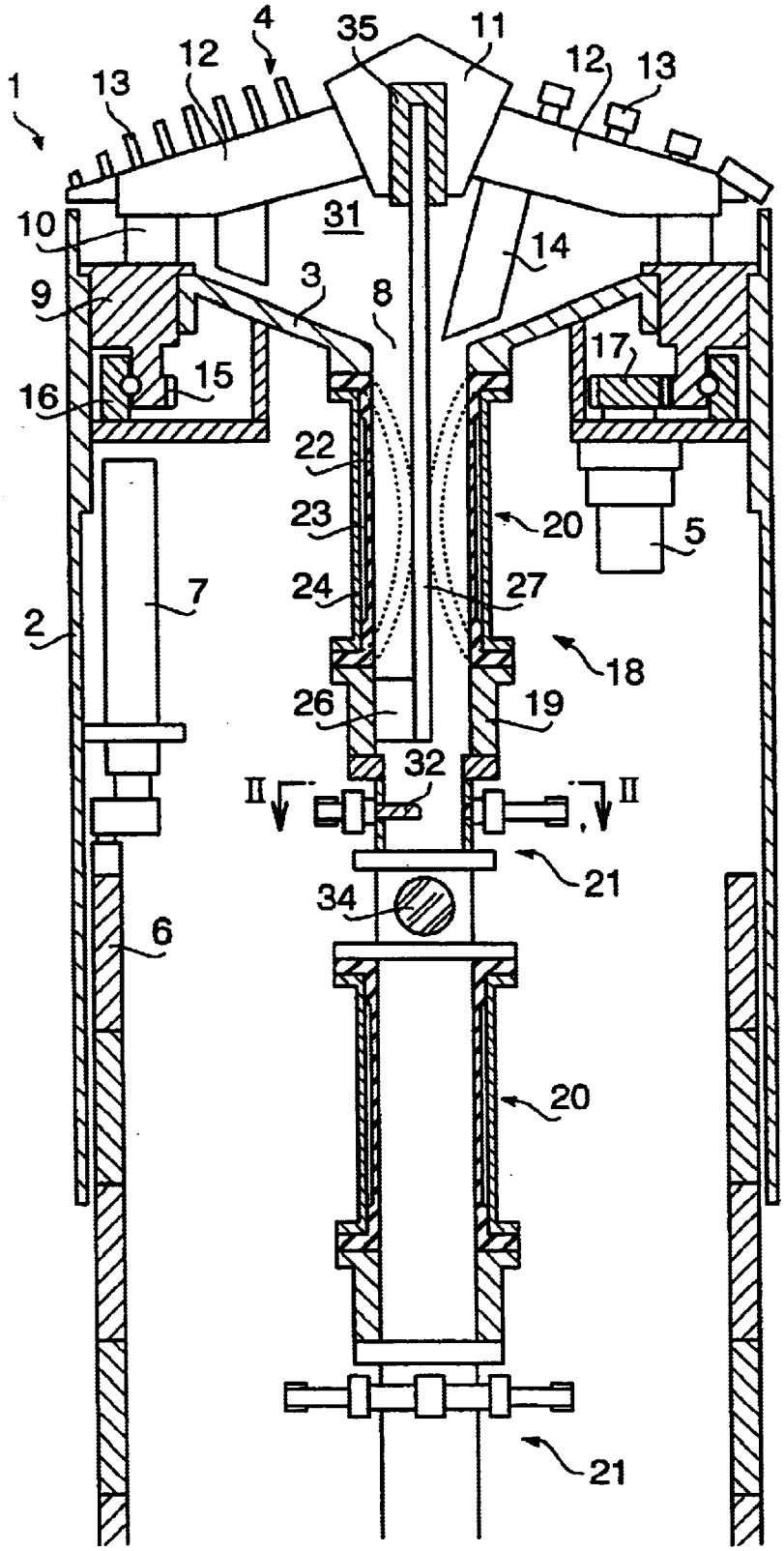
FIG. 1 is a side sectional view of an earth discharging device for an upward-facing shield machine according to an embodiment of the present invention.

As is illustrated in FIG. 1, an upward-facing shield machine 1 comprises: a tubular shield frame 2 which is placed vertically; a partition wall 3 which divides the interior of the shield frame 2 into a work face side and an interior side; and a cutter which is rotatably provided on the partition wall 3. The upward-facing shield machine 1 builds a tunnel in the vertical direction by causing a cutter 4 to rotate using a motor 5 while a jack 7 is expanded under a reaction force to a pre-installed segment 6 to cause the shield frame 2 to rise, whereupon the jack 7 is caused to contract so that a segment can be provided in a tensioned state in the space between the pre-installed segment 6 and the jack 7 manually or using an erector (not shown in the drawing).

In more detail, the partition wall 3 is formed as an arc having an earth discharging port 8 in its central portion. An annular rotating body 9 is rotatably supported between the partition wall 3 and the shield frame 2. The cutter 4 is mounted on the upper surface of the rotating body 9 via a support post 10. The cutter 4 is equipped with: a central portion 11 disposed in the rotational center; a plurality of cutter spokes 12 which extend radially from the central portion 11 and include the aforementioned support post 10; bits 13 mounted on the work face side of each of the cutter spokes; and a kneader blade 14 which is mounted on the opposite side thereto.

A ring gear 15 is provided on the lower surface of the rotating body 9. The ring gear 15 is axially supported by bearings 16 and meshed with a pinion 17 of the motor 5 so as to be rotationally driven. This upward-facing shield machine 1 builds a tunnel in the vertical direction by driving the motor 5 while causing the jack 7 which is mounted on the inner side of the shield frame 2 to expand, whereby the work face is gradually excavated by the cutter 4 to propel the machine upward under a reaction force to the pre-installed segment 6. After expanding to a predetermined stroke, the jack 7 is caused to contract and a segment is provided in a tensioned state in the space between the pre-installed segment 6 and the jack 7 manually or using an erector (not shown in the drawing).

An earth discharging device 18 is connected to the earth discharging port 8 in the partition wall 3. The earth discharging device 18 comprises: an earth discharging pipe 19 which is connected to the earth discharging port 8 and which extends downward; an elastic film-type valve 20 which is provided in the earth discharging pipe 19 and which opens and closes the interior of the earth discharging pipe 19 by expanding and contracting diametrically by means of fluid pressure; and a gate mechanism 21 which is provided in the earth discharging pipe 19 downstream of the elastic film-type valve 20 and which adjusts the sectional area of the space inside the earth discharging pipe 19 through which earth and sand pass.

Figure 4:
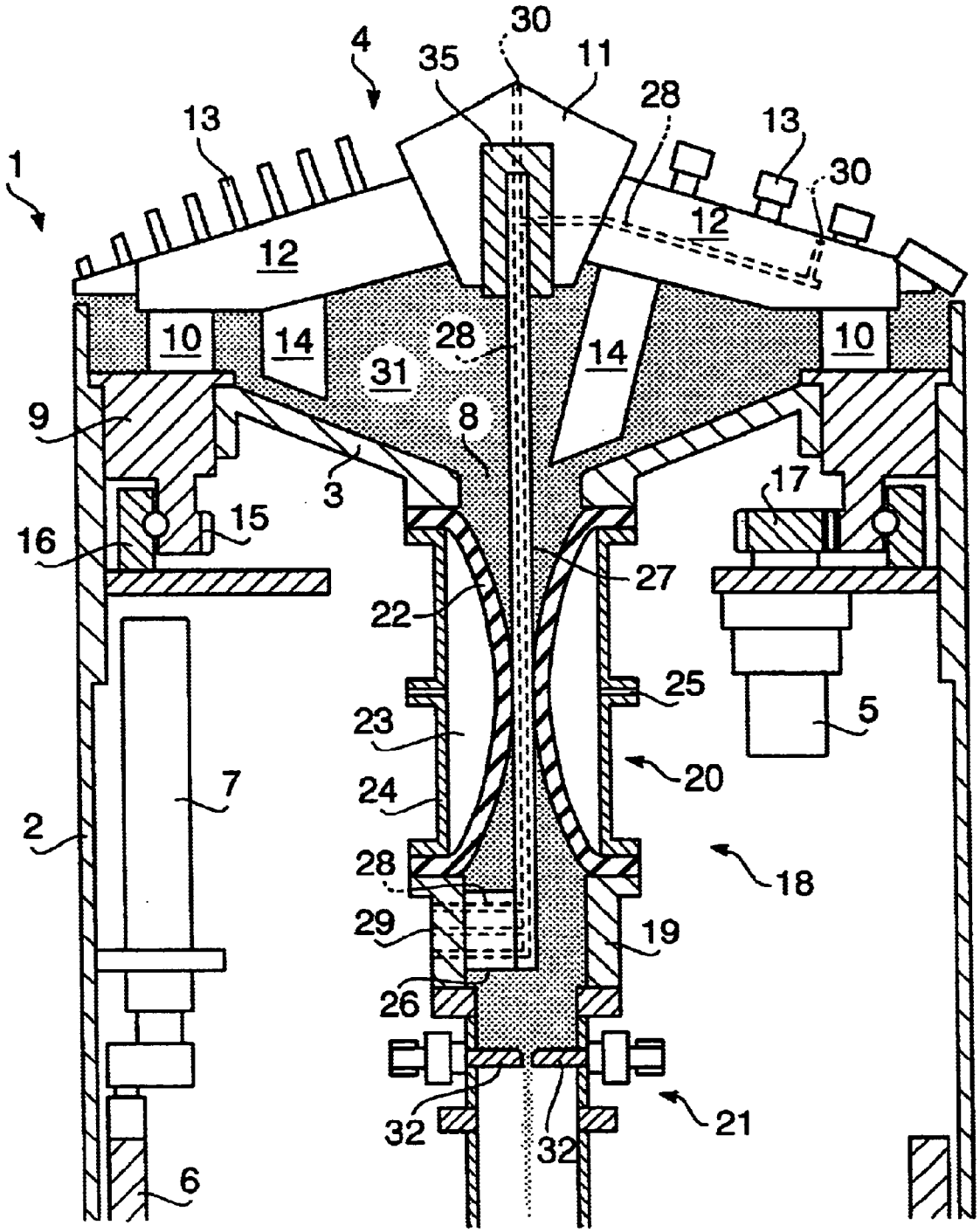
FIG. 4 is a partially enlarged view (with the gate mechanism closed) of FIG. 1.

As is illustrated in FIG. 4, the elastic film-type valve 20 comprises: a tubular elastic film 22 (rubber film or the like) which is disposed at a point in the earth discharging pipe 19; a tubular casing 24 which is disposed so as to surround the elastic film 22 and which forms a pressurizing chamber 23 with the peripheral surface of the elastic film 22; and a supply and discharge port 25 which is opened in the casing 24 and which supplies and discharges fluid (air, water, etc.) into and out of the pressurizing chamber 23. The elastic film-type valve 20 manages adjustments in the earth pressure at the work face by supplying and discharging fluid into and out of the pressurizing chamber 23 through the supply and discharge port 25 such that the elastic film 22 is caused to expand and contract diametrically to alter the sectional area of the space through which earth and sand pass, thereby adjusting the amount of earth to be discharged.

A bracket 26 which extends diametrically inward is provided in the earth discharging pipe 19 below the elastic film-type valve 20, and a center rod 27 which extends upward is attached to the bracket 26. The top of the center rod 27 is rotatably inserted into the central portion 11 of the cutter 4 via a rotary joint 35. A channel 28 for mud-forming agent is formed inside the bracket 26, center rod 27, rotary joint 35, and cutter 4. The mud-forming agent that is injected through an inlet 29 formed in the earth discharging pipe 19 passes through the channel 28 inside the bracket 26, center rod 27, and cutter 4 to be supplied to the work face from an outlet 30 provided on the work face side of the cutter 4.

The mud-forming agent that is supplied to the work face is mixed with the excavated earth and sand in accompaniment with the rotation of the cutter 4 and then this mixture is taken into a cutter chamber 31 and further kneaded by the kneader blade 14. Thereby, the excavated earth and sand are efficiently fluidized and it becomes easier for the excavated earth and sand to drop naturally into the earth discharging pipe 19 due to a gravitational force action. Further, the center rod 27 is disposed in the center of the earth discharging pipe 19 so that when the elastic film 22 of the elastic film-type valve 20 expands, the elastic film 22 is pressed against the center rod 27 to function as a type of valve seat.

Figure 2:
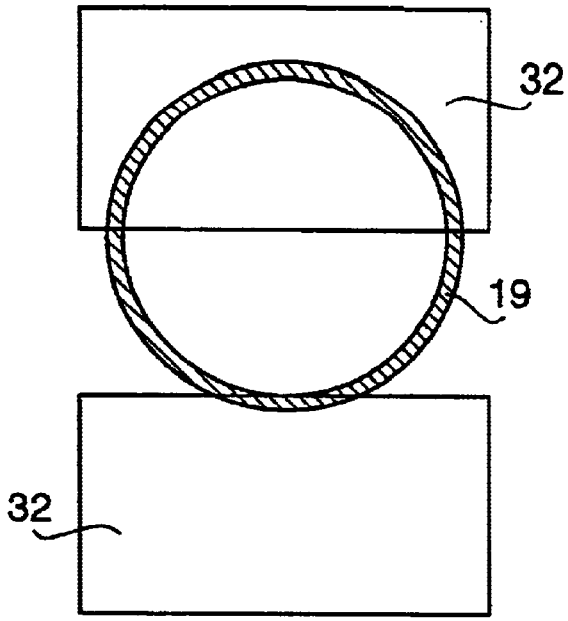
FIG. 2 is a sectional view of line II—II in FIG. 1, explaining a gate mechanism of the aforementioned earth discharging device.
Figure 3:
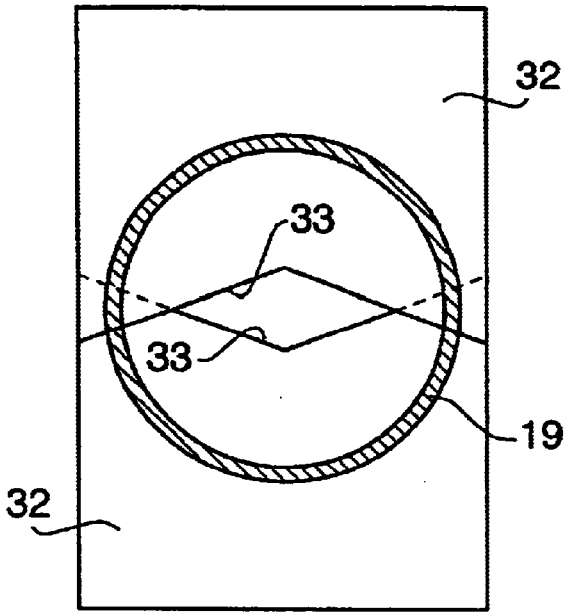
FIG. 3 is a view to explain a modified example of the aforementioned gate mechanism.

The gate mechanism 21 for adjusting the sectional area of the space in the earth discharging pipe 19 through which earth and sand pass is provided in the earth discharging pipe 19 below the center rod 27. As is also shown in FIG. 2, the gate mechanism 21 is comprised of a pair of gate plates 32 disposed so as to face each other proximally with a space therebetween. The gate mechanism 21 is operated by an actuator such as a cylinder that is well-known in the art, and adjusts the sectional area of the space in the earth discharging pipe 19 through which earth and sand pass. Note that cuts 33 may be provided in the gate plates 32 and overlapped in order to ameliorate adjustment of the sectional area of the space through which earth and sand pass, as is illustrated in FIG. 3. Further, the gate plates 32 are not limited to a pair, and instead a single swinging gate or three or more gates disposed in the fashion of a camera aperture may be employed.

As is shown in FIG. 1, an inspection panel 34 is provided in the earth discharging pipe 19 below the gate mechanism 21 for observing the transmission of the earth and sand. A transparent film is fitted over the inspection panel 34. Further, an elastic film-type valve 20 and gate mechanism 21 similar to those described above are provided in the earth discharging pipe 19 below the inspection panel 34. This lower elastic film-type valve 20 and gate mechanism 21 may be used as auxiliaries in the event of a breakdown in the upper elastic film-type valve 20 and gate mechanism 21. Moreover, by using both the upper and lower elastic film-type valves, the stability of earth pressure control at the work face can be further improved.

The operation of this embodiment will now be explained.

Figure 5:
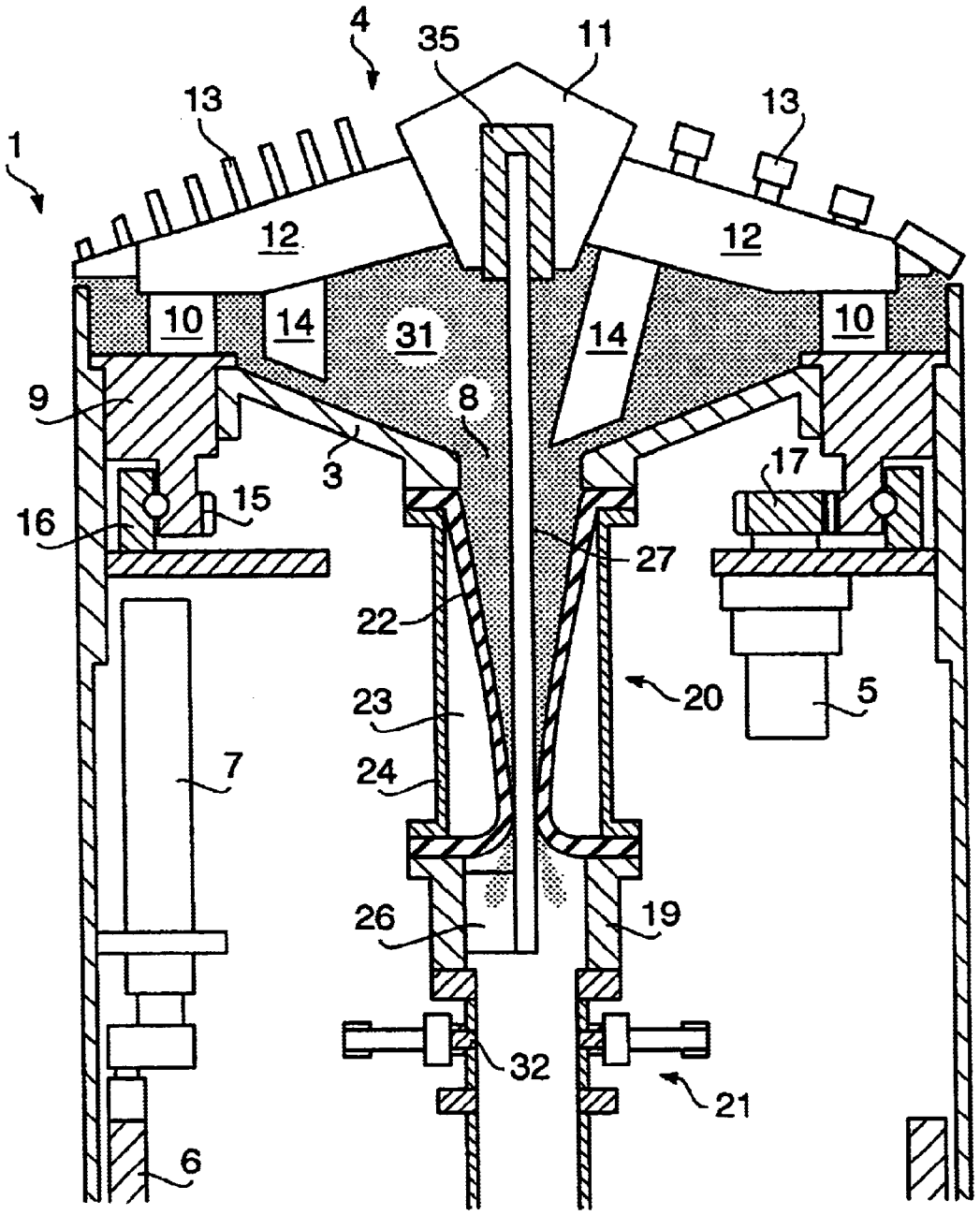
FIG. 5 is a partially enlarged view (with the gate mechanism open) of FIG. 1.
Figure 6:
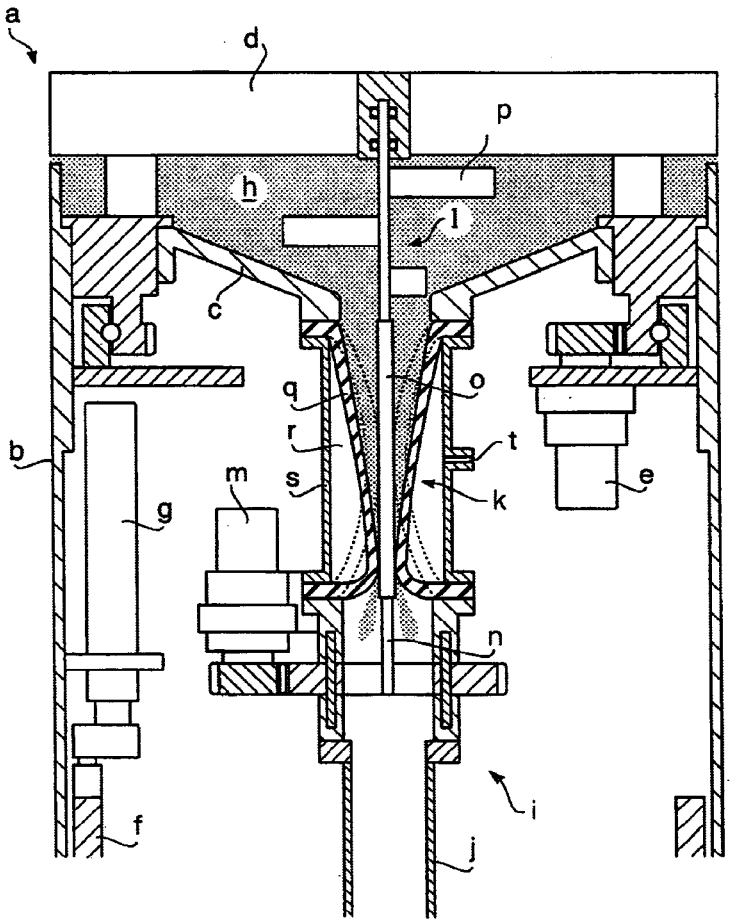
FIG. 6 is a side sectional view of an earth discharging device for an upward-facing shield machine previously disclosed by the present inventors.

As is illustrated in FIG. 4, during advance of the upward-facing shield machine 1, the sectional area of the space in the earth discharging pipe 19 through which the earth and sand pass is appropriately narrowed by the gate mechanism 21, thereby causing a slight blockage in the earth and sand on the outlet side of the elastic film-type valve 20 so as to raise the earth pressure thereof. As a result, the earth pressure on the outlet side of the elastic film-type valve 20 can be made substantially equal to the earth pressure (work face pressure) on the inlet side, and a substantially uniform earth pressure can be caused to act upon the entire elastic film 22. Accordingly, the elastic film 22 expands substantially uniformly without being pressed inward locally (as shown in FIG. 5), and is pressed inward by the entire elastic film-type valve 20. Thereby, earth pressure control at the work face can be performed securely regardless of the depth of advance or the type of soil being excavated.

In other words, as is shown in FIG. 5, if the gate mechanism 21 is left fully open, fluid pressure inside the pressurizing chamber 23 acts uniformly on the elastic film 22 such that the earth and sand passing through are at work face pressure (high pressure) on the inlet side and atmospheric pressure (low pressure) at the outlet side. As a result, the elastic film 22 does not expand uniformly but is pressed inward locally at the outlet side due to the pressure difference between the inlet side and the outlet side, thereby becoming tightly pressed against the center rod 27.

Consequently, the supply force of the fluid to the pressurizing chamber 23 in order to control earth pressure at the work face changes such that even when attempts are made to alter the sectional area of the space through which the earth and sand pass by varying the amount of expansion of the elastic film 22, the elastic film 22 is pressed tightly inward at its lower end due to the difference in pressure at the upper and lower ends, and thereby pressed tightly against the center rod 27. As a result, repeated blockages and eruptions of the earth and sand occur in response to only slight changes in the fluid pressure supplied to the pressurizing chamber 23, and earth pressure control at the work face becomes unstable.

The pressure difference in the elastic film-type valve 20 between the inlet side (work face pressure) and outlet side (atmospheric pressure) grows particularly large when advancing at great depth, and thus the elastic film 22 is locally pressed inward at the outlet side in accordance with this pressure difference, causing repeated earth and sand blockages and eruptions. Furthermore, in cases where the earth and sand are of a type, such as gravel with a large particle diameter or sandy soil with high frictional resistance, that is difficult to fluidize even using the kneader blade 14 or by injecting a mud-forming agent or the like, the earth and sand at the narrow opening of the elastic film 22, which is locally pressed inward, have a tendency to become blocked such that the frequency of eruptions increases. As a result, earth pressure control directly above the shield machine 1 becomes unstable, leading to the possibility of displacement at ground level.

Accordingly, as is illustrated in FIG. 4, by using the gate mechanism 21 to appropriately narrow the sectional area of the space inside the earth discharging pipe 19 through which the earth and sand pass, the earth pressure (back pressure) on the outlet side of the elastic film-type valve 20 increases such that a substantially uniform earth pressure is caused to act upon the entire elastic film 22. As a result, the elastic film 22 expands substantially uniformly, and, while pressed inward by the entire elastic film-type valve 20, becomes pressed against the center rod 27 at a strength which accords with the injection pressure of working fluid injected into the pressurizing chamber 23. Thus, by altering the injection pressure to a pressure which accords with the work face earth pressure, blockages and eruptions can be avoided, and secure earth pressure control of the work face can be performed regardless of the depth of advance or type of soil being excavated. Accordingly, displacement at ground level directly above the machine can be suppressed.

Further, when lumps of earth that cannot be discharged downward appear at an intermediate opening point of the gate mechanism 21 during such earth pressure management of the work face, it is possible to discharge these lumps of earth while maintaining the work face earth pressure by increasing the pressure of the fluid supplied from the elastic film-type valve 20 into the pressurizing chamber 23 such that the elastic film 22 expands to capacity, thereby causing [the gate mechanism 21] to close completely, and then by opening the gate mechanism 21 completely after the work face earth pressure has been maintained by the elastic film-type valve 20 [in this way].

As was described above, according to the earth discharging device for an upward-facing shield machine pertaining to this embodiment, the elastic film-type valve 20 inside the earth discharging pipe 19 can be caused to expand uniformly regardless of depth or soil type, whereby secure earth pressure control at the work face can be performed.

Note that the present invention is not limited to or by the aforementioned embodiment, and may be implemented in modified form within the scope of the patent claims.

What is claimed is:

1. An earth discharging device for an upward-facing shield machine comprising: an earth discharging pipe which is disposed vertically in order to discharge downward earth and sand which are excavated by an upward-facing shield machine that advances upward; an elastic film-type valve which is provided in said earth discharging pipe, and which opens and closes the interior of the earth discharging pipe by expanding and contracting diametrically by means of fluid pressure; and a gate mechanism made from a rigid body, which is provided further toward the outlet side of the earth discharging pipe than said elastic film-type valve, and which adjusts the sectional area of the space in the earth discharging pipe through which earth and sand pass, said gate mechanism narrowing the sectional area of the earth discharging pipe adjacent said elastic film-type valve by expanding said elastic film-type valve in response to said gate mechanism closing a predetermined amount and thereby causing pressure within said earth discharge pipe between said elastic film-type valve and said gate mechanism to rise so as to cause uniform pressure to act upon either side of said elastic film-type valve, wherein said elastic film-type valve expands substantially uniformly.

2. The earth discharging device for an upward-facing shield machine according to claim 1, wherein said elastic film-type valve comprises: a tubular elastic film which is disposed at a point in the earth discharging pipe; a tubular casing which is disposed so as to surround said elastic film, and which forms a pressurizing chamber with the elastic film; and a supply and discharge port which is opened in said casing, and which supplies and discharges fluid into and out of the pressurizing chamber.

3. The earth discharging device for an upward-facing shield machine according to claim 1 or claim 2, wherein a bracket extending diametrically inward is provided at a position below the elastic film-type valve and, and a center rod is provided on said bracket extending upward through the elastic film-type valve.

4. The earth discharging device for an upward-facing shield machine according to claim 3, wherein a cutter for cutting into a work face is rotatably attached to the upper end of said center rod via a rotary joint, and a channel for mud-forming agent is formed in the interior of said bracket, center rod and cutter.

5. The earth discharging device for an upward-facing shield machine according to claim 4, wherein said cutter is rotatably supported by a partition wall which divides the interior of a vertically-placed tubular shield frame into a work face side and an interior side.

6. The earth discharging device for an upward-facing shield machine according to claim 5, wherein a kneader blade is provided on the lower surface of said cutter.

7. The earth discharging device for an upward-facing shield machine according to claim 1, wherein said earth discharging pipe is connected to an earth discharging port which is formed in the partition wall which divides the interior of the vertically-placed tubular shield frame into a work face side and an interior side.

8. The earth discharging device for an upward-facing shield machine according to claim 7, wherein a central portion of said partition wall is formed in a recessed inverted arc shape, and said earth discharging port is formed in the central portion of the partition wall.

9. The earth discharging device for an upward-facing shield machine according to claim 8, wherein an annular rotating body is rotatably supported on said partition wall, and the cutter is provided on said rotating body via a support post.

10. The earth discharging device for an upward-facing shield machine according to claim 1, wherein said gate mechanism comprises a pair of gate plates disposed proximally facing each other with a space therebetween.

11. The earth discharging device for an upward-facing shield machine according to claim 1, wherein said gate mechanism has three or more gate plates disposed in the fashion of a camera aperture.

12. The earth discharging device for an upward-facing shield machine comprising an earth discharging pipe provided in top and bottom in the vertical direction in order to discharge downward earth and sand excavated by an upward-facing shield machine that advances upward, a top elastic film-type valve, which is provided in said earth discharging pipe and which expands and contracts diametrically by means of fluid pressure to open and close the interior of said earth discharging pipe, a top gate mechanism which is made of a rigid body, provided further toward the outlet side of the earth discharging pipe than said elastic film-type valve and which adjusts a sectional area of said earth discharging pipe through which earth and sand pass, a bottom elastic film-type valve which is provided further toward the outlet side of said earth discharging pipe than said top gate mechanism and which opens and closes the interior of said earth discharging pipe, and a bottom gate mechanism which is made of said rigid body, provided further toward said outlet side of said earth discharging pipe than said bottom elastic film-type valve and which adjusts a sectional area of said earth discharging pipe through which earth and sand pass.

13. An earth discharging device for an upward-facing shield machine comprising: a vertically-placed tubular shield frame; a partition wall for dividing the interior of said shield frame into a work face side and an interior side; an annular rotating body which is rotatably mounted on said partition wall; a cutter which is provided on said partition wall via a support post; an earth discharging port which is opened in the central portion of said partition wall; an earth discharging pipe which is connected to said earth discharging port and extends downward; an elastic film-type valve which is provided in said earth discharging pipe, and which expands and contracts in a diametrical direction by means of fluid pressure to open and close the interior of the earth discharging pipe; and a gate mechanism made of a rigid body that is provided further toward the outlet side of the earth discharging pipe than said elastic film-type valve, and which adjusts the sectional area of the space inside the earth discharging pipe through which earth and sand pass and which narrows the sectional area of the earth discharging pipe adjacent to said elastic film-type valve by expanding said elastic film-type valve in response to said gate mechanism closing by a predetermined amount, thereby causing earth pressure between said elastic film-type valve and said gate mechanism to rise so as to make uniform earth pressure act upon an entirety of said elastic film-type valve, wherein said elastic film-type valve expands substantially uniformly.

14. The earth discharging device for an upward-facing shield machine according to claim 13, wherein a bracket extending diametrically inward is provided at a position below the elastic film-type valve and, a center rod is provided on said bracket extending upward through the elastic film-type valve, a rotary joint is provided between the upper end of said center rod and the cutter, and a channel for mud-forming agent is formed in the interior of said bracket, center rod, and cutter.

15. The earth discharging device for an upward-facing shield machine according to claim 13, wherein a central portion of said partition wall is formed in a recessed inverted arc shape, and a kneader blade is provided on the lower surface of said cutter.

16. The earth discharging device for an upward-facing shield machine according to claim 13, wherein said elastic film-type valve comprises: a tubular elastic film which is disposed at a point in the earth discharging pipe; a tubular casing which is disposed so as to surround said elastic film, and which forms a pressurizing chamber with the elastic film; and a supply and discharge port which is opened in said casing, and which supplies and discharges fluid into and out of the pressurizing chamber.

17. The earth discharging device for an upward-facing shield machine according to claim 13, wherein said gate mechanism comprises a pair of gate plates disposed proximally facing each other with a space therebetween.

18. A method for discharging downward earth and sand excavated by an upward-facing shield machine that advances upward, wherein, when the sectional area of a space through which earth and sand pass in the interior of an earth discharging pipe disposed in a longitudinal direction is narrowed by an elastic film-type valve which expands diametrically due to fluid pressure, the sectional area of a space through which earth and sand pass in the interior of a section of the earth discharging pipe which is downstream of said elastic film-type valve is adjusted by a gate mechanism made from a rigid body, whereby the earth and sand which are downstream of said elastic film-type valve are slightly blocked so as to raise the earth pressure of said earth and sand, thereby causing uniform earth pressure to act upon an entirety of said elastic film-type valve, wherein said elastic film-type valve expands substantially uniformly.

19. The method for discharging earth in an upward-facing shield machine according to claim 18, wherein earth and sand which have been kneaded and fluidized by a kneader blade provided on a rear face portion of a cutter which cuts into a work face are supplied to said earth discharging pipe by a gravitational force action.

20. The method for discharging earth in an upward-facing shield machine according to claim 19, wherein mud-forming agent is injected from said cutter toward the work face, and said mud-forming agent is mixed with excavated earth and sand by the kneader blade in accompaniment with the rotation of the cutter, thereby fluidizing the earth and sand.

* * * * *